United States Patent [19]

Shonerd et al.

[11] 4,108,327

[45] Aug. 22, 1978

[54] WALL-END SECUREMENT FOR PRESSURE RESERVOIRS HAVING AUTOMATIC SAFETY PRESSURE RELIEF

[75] Inventors: David E. Shonerd, Anaheim; Carlos Danze, Huntington Beach, both of Calif.

[73] Assignee: American Safety Equipment Corporation, Encino, Calif.

[21] Appl. No.: 739,957

[22] Filed: Nov. 8, 1976

[51] Int. Cl.[2] ..... B65D 51/16

[52] U.S. Cl. ..... 220/3; 113/120 S; 113/120 Y; 137/67; 220/208; 220/366; 220/378; 222/397

[58] Field of Search ..... 285/1, 2, 3, 13, 114, 285/106, 349; 137/67, 68, 860; 277/29, 165, 188 R, 188 A; 220/3, 378, 366, 88 R, 89 A, 81 R, 240, 208, 209, 203; 113/120 Y, 120 S; 222/397

[56] References Cited

U.S. PATENT DOCUMENTS

| | | | |
|---|---|---|---|
| 2,322,213 | 6/1943 | Amberg | 285/206 |
| 2,532,227 | 11/1950 | Heath | 220/81 R |
| 2,574,273 | 11/1951 | McLeod | 220/81 |
| 2,957,734 | 10/1960 | McLeod | 220/81 |
| 3,256,117 | 6/1966 | Howatt et al. | 220/209 |
| 3,359,013 | 12/1967 | Knox et al. | 285/13 |
| 3,459,369 | 8/1969 | Marks | 220/3 |
| 3,635,370 | 1/1972 | Romanauskas | 220/3 |
| 3,847,819 | 11/1974 | Firth et al. | 220/378 |

*Primary Examiner*—William Price

*Assistant Examiner*—Allan N. Shoap

*Attorney, Agent, or Firm*—Poms, Smith, Lande & Glenny

[57] ABSTRACT

A tubular wall is axially telescoped over an end closure and a wall outer end portion is secured to the end closure so that complete separation between the wall and end closure will not take place up to internal reservoir pressures spaced above a predetermined pressure, but at the same time, such securement permitting fluid flow outwardly between the wall and end closure at reservoir pressures at least as low as the predetermined pressure. A wall inner end portion is formed in an annular zone arcuately inwardly against a resilient sealing ring positioned in an end closure arcuate recess compressing the sealing ring against the end closure. By selecting the physical characteristics of the wall and sealing ring, the compressive force of the wall against the sealing ring retains reservoir pressure up to the predetermined pressure and automatically at least temporarily deforms to permit fluid flow by the sealing ring and outwardly between the wall and end closure above the predetermined pressure thereby providing automatic safety relief of any attempted pressures above the predetermined pressure. The securement of the wall outer end portion with the closure member may be by formation of the wall over an annular shoulder of the closure member depending on inherent rigidity of the wall for securement or formation of the wall along an outer end surface of the closure member with pressure clamping by a clamping ring.

16 Claims, 6 Drawing Figures

WALL-END SECUREMENT FOR PRESSURE RESERVOIRS HAVING AUTOMATIC SAFETY PRESSURE RELIEF

BACKGROUND OF THE INVENTION

This invention relates to the construction and use of pressure reservoirs and is particularly useful in pressure reservoirs of various types of life support systems and equipment related thereto. According to the pressure reservoir improvements of the present invention, a last-resort safety feature which is virtually incapable of deliberate or accidental frustration is directly incorporated in the pressure reservoir structure through the inherent formation and assembly thereof which will absolutely prevent reservoir contained fluid pressure rising above a predetermined maximum pressure always positively relieving pressures above the predetermined maximum. The result is that by properly selecting the materials from which the pressure reservoir is fabricated, and even though all other safety devices in the particular system fail, such as pressure safety valves or pressure blow-out plugs, the contained pressures within the reservoir can never rise sufficiently to cause accidental explosive disassembly or shattering which could endanger human life.

Various forms of fully portable, life supporting human breathing equipment have heretofore been provided and that most commonly used in recent times has generally included a relatively large and bulky compressed air reservoir or tank usually strapped to the back of the person using the system and having appropriate pressure reducing controls and face mask presenting air to the person in proper breathing form. For instance, such equipment has been used by firemen required to enter areas where the air is contaminated, other rescue personnel under the same conditions and underwater divers for both working and recreational purposes. The compressed air reservoirs of this form of equipment have contained compressed air stored at a pressure of two thousand pounds per square inch and due to the size and weight of the reservoirs, the persons using the same must be of relatively high physical dexterity.

With the advent of modern technology, however, the portable, life supporting human breathing equipment is fast progressing into the use of compressed air reservoirs of greatly reduced size and weight, along with greatly increased contained pressures. At the present time, the technology has increased to the point that maxiumum pressures of six thousand pounds per square inch of compressed air are permissible and used so that the same amount of human breathing air may obviously be contained in a compressed air reservoir of greatly reduced size. These smaller, high pressure, compressed air reservoirs are not only being designed into the human breathing equipment used by the personnel previously required to use such equipment, but have also opened up a quite large field of use for life supporting human breathing equipment by virtually anyone, regardless of size, in order to sustain their lives under emergency conditions.

In case of the firemen, other emergency personnel and underwater divers, with the smaller, high pressure, compressed air reservoirs, the same air supply may be provided in a greatly reduced size and bulk giving greater working freedom, or greatly increased breathing time may be provided while only approaching the size and weight of the prior reservoirs. At the same time, again due to the smaller, higher pressure, compressed air reservoirs, human breathing equipment may be provided for virtually anyone to sustain their breathing requirements for relatively short periods of time from say, a few minutes to nine or ten minutes. This means that with such short term, emergency human breathing equipment, many emergency situations that have previously caused the loss of life will no longer do so if the appropriate equipment is readily available.

Merely as an example of the great number of possibilities of use of the short term, human breathing equipment made possible by the smaller, high pressure, compressed air reservoirs and their related components, consider the possibilities of industrial accidents involving the accidental release of quantities of deadly fumes and gases. Where workmen are required to work in enclosed industrial areas, the normal atmospheric conditions thereof being perfectly safe for normal human breathing, but where deadly gases are present which, through control or transmitting type failure, quantities of the deadly gas can be released into the atmosphere by such an accidental failure, the provision of individual, portable, short term human breathing equipment readily available at each worker location can provide each workman with life sustaining breathing air of sufficient quantity for escape from the contaminated area. For instance, as soon as the accidental gas release occurs, each workmen would be trained to immediately locate and put on his individual human breathing equipment which would provide him with proper breathing air despite the surrounding deadly gas and it is only then necessary for him to move directly to a preplanned exit from the area within the next few minutes in order to be removed from danger. As stated, these individual, fully portable, short term human breathing assemblies can be of quite small size and relatively low weight so that the size and physical capabilities of the person using the same are really not an important factor.

Another example of possible use of these short term, fully portable, human breathing devices is in commercial aircraft accidents. It is well known that in commercial aircraft accidents, there are many occasions where a large number of passengers easily survive the initial impact but yet an ensuing fire within the aircraft will cause the death of a large number of these survivors merely due to the lack of life sustaining air during attempted escape. By the provision of one of these small human breathing devices at the location of each passenger seat and with previously given instructions, it is possible for each passenger to quickly put on and actuate the device to give them the few minutes of life sustaining breathing air in order to execute the escape from the burning aircraft.

Thus, the advancements in the portable, air breathing equipment field are providing quite practical and workable results in an ever expanding field of the preservation of human life, but one of the very important factors that must be kept in mind is the increase in problems of equipment design and fabrication resulting from the advancement from relatively low pressure, large and relatively heavy, compressed air reservoirs or tanks to the smaller, but quite markedly higher pressure reservoirs or tanks. Although any reservoir required to contain pressurized gas always presents certain serious structural problems from the safety standpoint, it is obvious that reservoirs operating at the present high maximum pressures greatly multiply the dangers involved. At a maximum pressure of six thousand pounds per square inch, failure of a reservoir by instantaneous partial disassembly or shattering is of a highly explosive nature quite seriously endangering human life and property and must be positively avoided.

Even though the various components of the higher pressure air breathing systems are necessarily of an advanced nature, various forms of safety devices are incorporated to meet the foregoing higher pressure containing problem. Pressure safety valves and/or pressure blow-out plugs are installed in the system, particularly the high pressure portion thereof, in order to relieve the pressure if the pressure should for some malfunctioning or accidental reason begin to build above a certain predetermined maximum spaced above the normal maximum operating pressure. For instance, with a maximum operating reservoir pressure of 5,000 pounds per square inch, the safety valve or blow-out plug would be set to release at a range in the order of 7,000 pounds per square inch to 7,500 pounds per square inch which, in turn, would be well below any pressures which would present the dangers of reservoir disassembly and shattering. Despite these safety devices, however, there still remains the possible dangers of safety device malfunctioning, accidental damage or deliberate tampering.

OBJECTS AND SUMMARY OF THE INVENTION

It is, therefore, an object of this invention to provide a pressure reservoir particularly usable in high pressure, portable air breathing equipment which directly through the unique construction and assembly thereof provides an absolute and positive pressure relief preventing any possibility of pressures rising to a danger presenting the problems of explosive disassembly or shattering. With this pressure reservoir of the present invention, even though for some reason the maximum intended operating pressure of the pressure reservoir is exceeded and any safety device incorporated in the system directly or indirectly therewith fails, the pressure can only rise to a predetermined maximum, at which time, pressure relief begins and persists. Thus, even though the source of attempted pressure rise continues to effect the pressure reservoir, the predetermined maximum pressure, precalculated well below the explosive disassembly or shattering pressure of the reservoir, can never be exceeded.

It is a further object of this invention to provide a pressure reservoir of the foregoing use and having the unique safety pressure relief qualities wherein the safety pressure relief is of absolute automatic operation and is not subject to the possible malfunctioning, accidental damage or tampering disabilities which can occur with the normal pressure safety valves and pressure blow-out plugs. By proper original precalculation and material characteristic selection, the unique safety pressure relief attributes are automatically built into the inherent structure of the pressure reservoir by the particular manner of fabrication and assembly thereof. Thus, the safety pressure relief structure automatically results from the inherent structure during such assembly, thereby eliminating any of the extraneous operational factors which give rise to the possible deficiencies of the usual form of safety devices.

It is also an object of this invention to provide a pressure reservoir having all of the automatic pressure relief attributes as hereinbefore discussed, but yet which can be included in a pressure reservoir structure of quite simplistic and economical form. According to preferred embodiments of the pressure reservoir of the present invention, the positive pressure relief concept of the present invention is physically incorporated directly in the wall-end securement structure of the pressure reservoir during manufacture thereof. Under normal operating pressures as precalculated for the particular pressure reservoirs, this unique wall-end securement serves to perfectly seal the pressure reservoir and contain the pressurized air at and below these normal operating pressures, but if the reservoir pressures for any reason begin to rise within the reservoir and ultimately reach the precalculated pressure relief maximum, the inherent formation of the wall-end securement automatically begins to permit compressed air escape and will never permit the air pressure to rise above that precalculated maximum pressure and approach greater magnitudes which could cause the life endangering explosive disassembly or shattering. Thus, an important pressure relief safety system is included simply through inherent qualities of a relatively simple and economical wall-end securement.

Other objects and advantages of the invention will be apparent from the following specification and the accompanying drawings which are for the purpose of illustration only.

DESCRIPTION OF THE BEST EMBODIMENTS CONTEMPLATED

Figure 1:
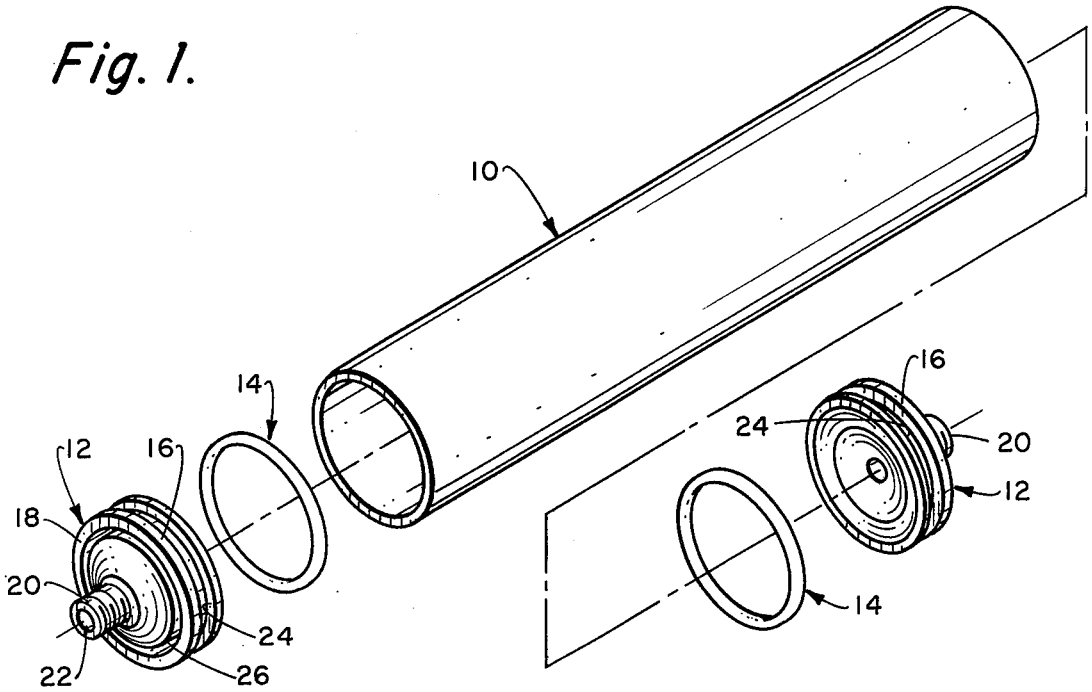
FIG. 1 is an exploded, perspective view of the disassembled component parts illustrating a preferred first embodiment of the pressure reservoir of the present invention ready for assembly into a final pressure reservoir.
Figure 2:
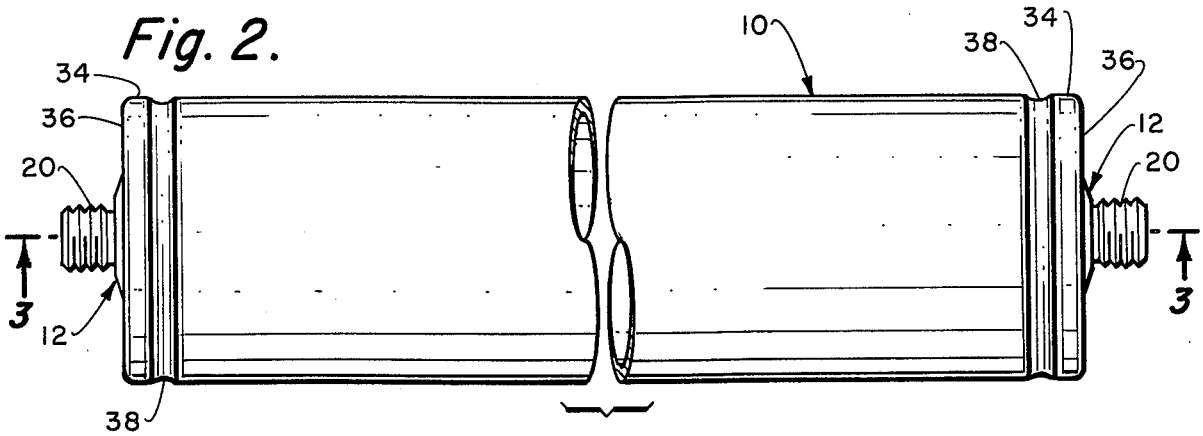
FIG. 2 is an enlarged, fragmentary, side elevational view of the pressure reservoir of FIG. 1 after assembly and ready for use.

Referring to FIGS. 1 through 4 of the drawings, a first embodiment of a pressure reservoir particularly useful in life support, portable air breathing equipment and incorporating the wall-end securement principles of the present invention is shown in both disassembled and assembled form. As shown, the pressure reservoir includes an axially extending, hollow cylindrical or tubular wall generally indicated at 10, two substantially identical end closures generally indicated at 12 and two, substantially identical annular seals or sealing rings generally indicated at 14. Where the pressure reservoir is to contain the relatively high pressure air, the tubular wall 10 and end closures 12 are preferably formed of steel of precalculated appropriate strength and the sealing rings 14 are formed of high quality resilient materials capable of serving the intended purposes according to the present invention and as will be hereinafter described more in detail. In all cases, the various components are manufactured in the usual manner, all well known to those skilled in the art.

More particularly, the tubular wall 10 is preferably relatively thin, uniform wall thickness throughout prior to assembly and the end closures 12 are of markedly increased thickness so as to be comparatively relatively rigid. The end closures 12 are each formed with a generally axially extending side surface 16 and a somewhat radially extending outer end surface 18, the latter having a threaded connector 20 projecting axially outwardly centrally thereof and with an access opening 22 formed axially through the end closure coaxially of the threaded connector. For important purposes of the present invention, each of the end closures 12 has a radially outwardly opening, annular recess 24 formed axially intermediate the side surface 16 thereof spaced axially inwardly of the outer end surface 18, and an axially outwardly opening, annular groove 26 formed in the outer end surface 18 thereof, spaced radially from the side surface 16.

Figure 4:
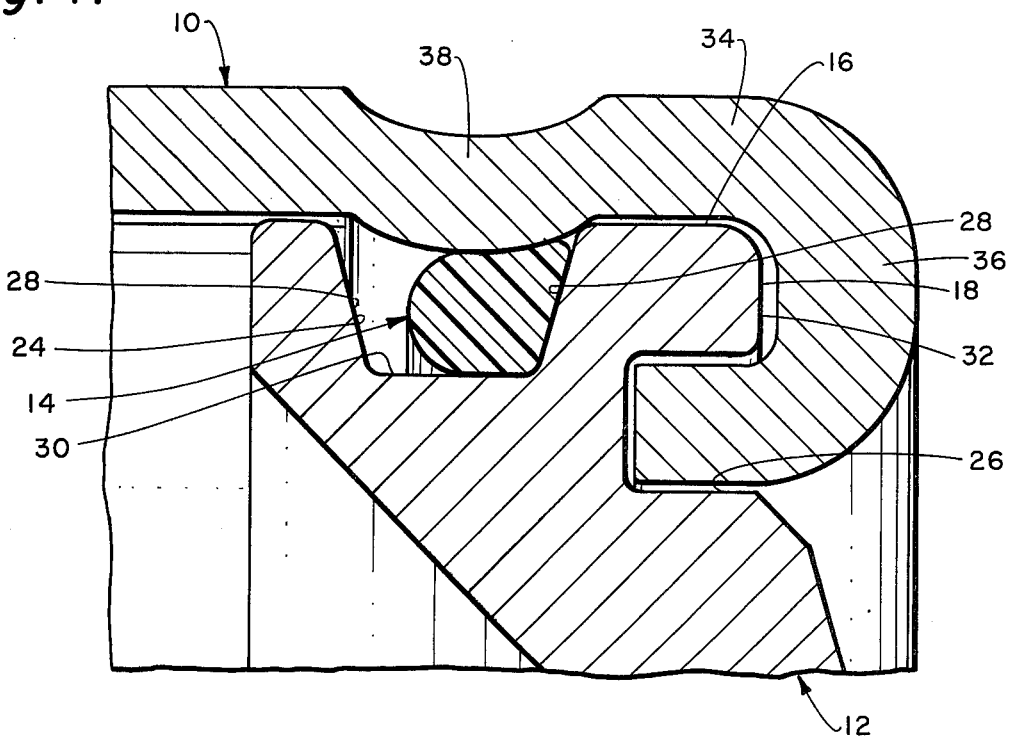
FIG. 4 is a fragmentary, enlarged horizontal sectional view taken from FIG. 3 and more clearly illustrating the wall-end securement of the pressure reservoir of FIG. 3.

As shown enlarged in FIG.4, each of the side surface annular recesses 24 of the end closures 12 preferably has angular radial sides 28 and a relatively flat, axial bottom 30. The outer end surface grooves 26 of the end closures 12 are each preferably U-shaped in cross section and of slightly greater width than the thickness of the tubular wall 10. It will be noted that with the relative positioning of each of the annular grooves 26 in the end closure outer end surfaces 18, such grooves, in effect, form an axially outwardly extending, annular shoulder 32 on the outer end surface preferably with slightly arcuately rounded outer corners, such corner formation to augment pressure reservoir assembly as will be hereinafter described.

Starting with the tubular wall 10, end closures 12 and sealing rings 14 as shown in FIG. 1 the ends of the tubular wall at this stage being straight and the sealing rings preferably being O-rings, the assembly of the tubular wall with each of the end closures is the same so that a description of one is sufficient for the other. The sealing ring 14 is mounted in the side surface annular recess 24 of the end closure 12 and the end of the tubular wall 10 is telescoped over the end closure 12 so that a wall inner end portion 34 lies radially adjacent and axially spanning the side surface annular recess 24 of the end closure with a wall outer end portion 36 extending axially beyond the end closure outer end surface 18. At this stage, there is little, if any, compression of the tubular wall 10 against the now end closure positioned sealing ring 14.

Figure 3:
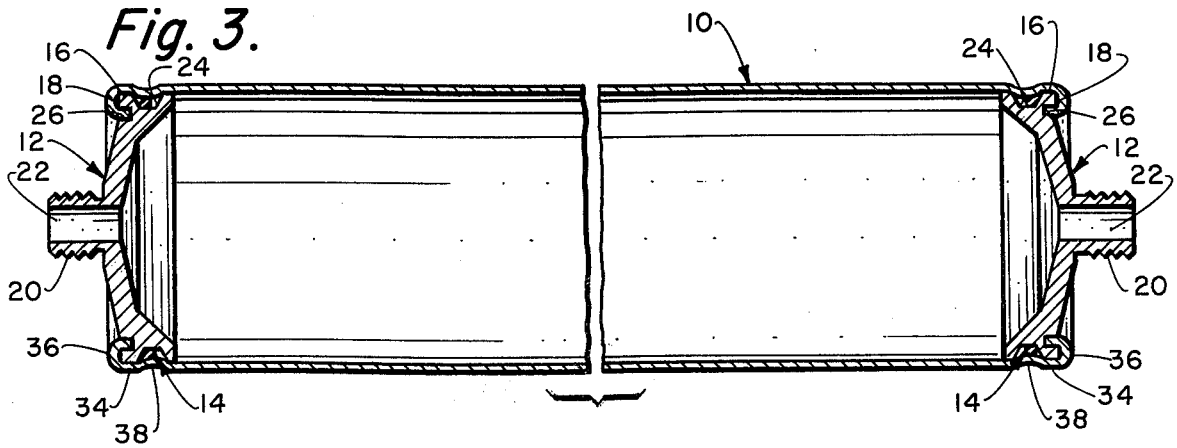
FIG. 3 is a fragmentary, horizontal sectional view looking in the direction of the arrows 3—3 in FIG. 2.

The wall outer end portion 36 is formed radially along the end closure outer end surface 18 over the end closure annular shoulder 32 and reversely axially into the end closure annular groove 26, the previously described arcuate corners of the end closure annular shoulder permitting a smooth arcuate formation of the wall outer end portion as shown in FIGS. 3 and 4. The final wall-end securement step is the arcuate formation of an annular pressure sealing part 38 of the wall inner end portion 34 radially inwardly, preferably into the end closure side surface recess 24, and particularly compressively against the sealing ring 14. Again as shown in FIGS. 3 and 4, this arcuate inner formation of the wall annular pressure sealing part 38 is a very closely controlled operation, preferably by rolling, and preferably in such a manner that the wall annular pressure sealing part 38 compresses the resilient sealing ring 14 a determined compressive amount against both the axially outermost of the recess angular radial sides 28 and the recess flat axial bottom 30.

By a proper calculated selection of the characteristics of the tubular wall 10 and the sealing rings 14 appropriate for the conditions to be met and in a manner well known to those skilled in the art, the engagement between the wall outer end portion 36 and the end closure 12 will provide a positive wall retention force sufficient for positively securing the tubular wall 10 with the end closure at least against complete retention separation by forces created by fluid pressures within the pressure reservoir spaced well above a predetermined pressure while at the same time, due to the mere metal to metal abutment between the tubular wall and end closure, such connection will be free of fluid pressure sealing and will permit fluid flow therebetween at least at reservoir pressures at and above the predetermined pressure. By the same calculated selection, the compression between the wall annular pressure sealing part 38 and the sealing ring 14 producing compression between the sealing ring and the end closure 12 will be of a magnitude producing pressure sealing such that normally fluid or air flow outwardly around the end closure between the tubular wall and end closure will be prevented to a reservoir pressure above the predetermined pressure, but at the predetermined pressure, the tubular wall will at least temporarily begin to deform to move the wall annular pressure sealing part 38 in the direction or directions partially away from the sealing ring 14, in the specific structure illustrated both axial and radial directions, thereby permitting pressurized fluid or air flow between the wall and end closure automatically relieving reservoir pressures rising above the predetermined pressure. The wall pressure relief deformation may be at least partially permanent once having taken place or totally temporary depending on the particular materials chosen. The overall result is that with proper precalculation and selection, pressures can be contained within the pressure reservoir up to the predetermined pressure, but as soon as that predetermined pressure is attempted to be exceeded, the tubular wall 10 will automatically deform sufficient to relieve sealing and permit automatic pressure relief, all well within the pressure limits far below those that could possibly cause an accidental complete retention separation between the tubular wall 10 and the end closure 12.

Thus, by completion of both of the wall-end securements in the same manner, the pressure reservoir is complete and ready for assembly into a typical life supporting human breathing system. For instance, a usual pressure safety valve or pressure blow-out plug may be operationally mounted at the threaded connector 20 exposed to the access opening 22 of one of the end closures 12 and that of the other end closure connected with appropriate controls for supplying air into the life supporting human breathing system. Since the automatic safety pressure relief incorporated in the wall-end securements of the present invention is intended for the last resort safety purposes in the event of failure of all other controls, the safety valves or plugs would be set to relieve at pressures spaced well below the predetermined pressure. Furthermore, where a safety valve or plug was incorporated into the system sensitive to the internal pressures of the pressure reservoir but not attached directly to the pressure reservoir, the pressure reservoir could be of a form including only a single end closure with the other end integral with the reservoir tubular wall since the same automatic safety pressure relief would be provided by the single end closure.

As a practical example of a pressure reservoir manufactured according to the first embodiment just described, the pressure reservoir had an overall length of eight inches, an effective compressed air containing length of slightly less than seven inches and an effective diameter of slightly less than one and three quarter inches. The tubular wall 10 was formed of 4130 steel with Rockwell hardness of C25 to C28 and a wall thickness of eightythree one thousandth inches. Such a pressure reservoir is rated for use with a maximum contained air pressure of 5,000 pounds per square inch and starting with that working pressure, one reservoir would supply sufficient air to support human breathing for 2 to 3 minutes and three reservoirs for 6 to 9 minutes as above discussed.

Regulations would require such a pressure reservoir to have a pressure safety valve or pressure blow-out plug connected in internal communication therewith set to release in the range of 7000 pounds per square inch to 7500 pounds per square inch. The pressure reservoir must be tested to approximately eighty three hundred pounds per square inch without failure and the pressure reservoir constructed successfully completed such test. The pressure reservoir was then tested for failure and the automatic safety pressure relief provided by the wall-end securement of the pressure invention began at approximately fourteen thousand pounds per square inch and such pressure could never be exceeded due to the automatic pressure relief. There was never sufficient tubular wall deformation which even remotely approached the state of possible complete wall and end closure separation.

Figure 5:
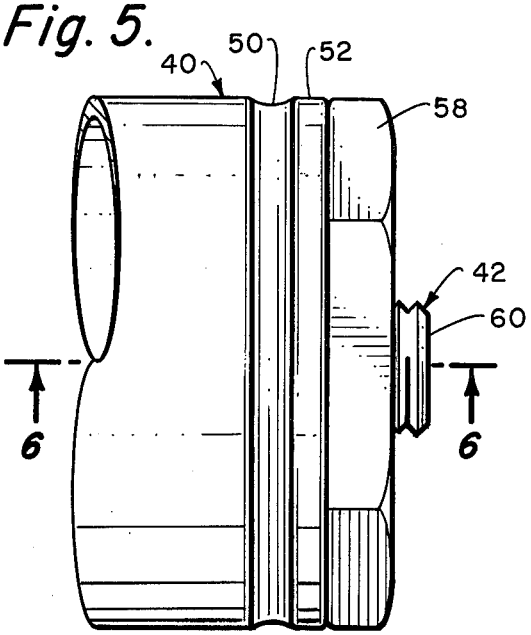
FIG. 5 is a fragmentary, side elevational view of a second embodiment of the pressure reservoir of the present invention.
Figure 6:
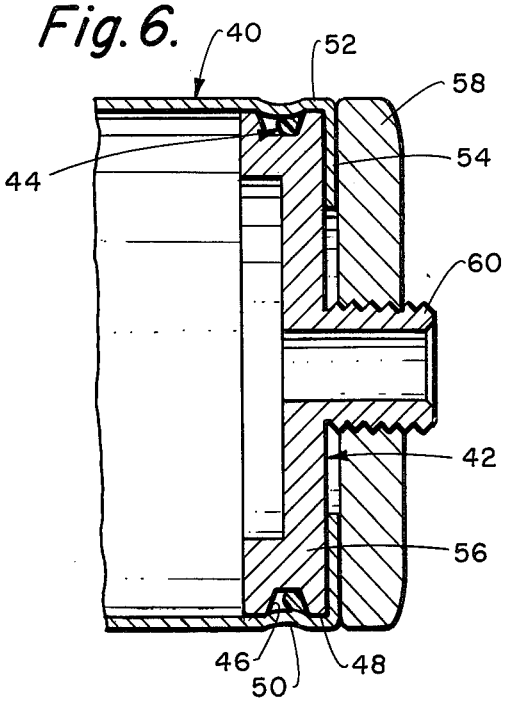
FIG. 6 is a fragmentary, horizontal sectional view looking in the direction of the arrow 6—6 in FIG. 5.

A second or alternate embodiment of the wall-end securement principles of the present invention is shown in FIGS. 5 and 6 and as illustrated therein, a pressure reservoir has substantially the same tubular wall generally indicated at 40, a similar end closure generally at 42 and substantially the same sealing ring generally indicated at 44. The end closure 42 has the same annular recess 46 formed in a side surface 48 thereof receiving the sealing ring 44 compressed in the same manner by an arcuate annular pressure sealing part 50 of a wall inner end portion 52. The principal difference between this second embodiment and the first embodiment is that a wall outer end portion 54 extends radially along a relatively flat, radial outer end surface 56 of the end closure 42 and is pressure clamped thereagainst by a pressure abutment collar 58 threadably received over an end closure threaded connector 60.

The method of assembly and the operational results are essentially the same. The metal-to-metal abutment between the tubular wall 40, end closure 42 and the abutment collar 58 permits pressurized fluid or air flow outwardly between the wall and end closure at least at pressures at and above the predetermined pressure while positively retaining the wall outer end portion 54 at forces created by pressures within the pressure reservoir spaced well above the predetermined pressure at least against complete retention separation between the wall and end closure. The compression between the pressure sealing part 50 of the wall inner end portion 52 and the sealing ring 44 against the end closure 42 normally is capable of sealing against pressurized fluid or air flow outwardly to a reservoir pressure above the predetermined pressure, but upon the reservoir pressure rising to the predetermined pressure and attempting to rise thereabove, the tubular wall 40 at least temporarily deforms to relieve pressures above the predetermined pressure, all as hereinbefore discussed.

According to the principles of the present invention, therefore, a unique concept of wall-end securement for pressure reservoirs has been provided having an ultimate automatic safety pressure relief inherently incorporated therein. Thus, despite the failure of any other safety pressure controls connected with the pressure reservoir, the reservoir can never contain pressures of sufficient magnitude which could cause explosive disassembly or shattering thereof which could endanger human life and property. Furthermore, despite the extremely valuable added advantages thereof, not only is the wall-end securement of the present invention virtually foolproof and tamper-proof, but it may be incorporated in a pressure reservoir for a minimum of cost.

We claim:

1. In a pressure fluid reservoir having automatic fluid pressure relief above a reservoir predetermined pressure; the combination of: an axially extending tubular wall having an inner end portion terminating outwardly in an outer end portion; a relatively rigid end closure telescoped by said tubular wall end portion, said end closure having an annular recess formed therein opening against said tubular wall inner end portion; a sealing ring in said end closure recess; said wall inner end portion having an annular pressure sealing part formed annularly into said end closure recess against and compressing said sealing ring normally being capable of sealing against fluid flow outwardly around said end closure between said tubular wall and end closure up to said predetermined pressure; positive wall retention means between said wall outer end portion and said end closure for positively securing said wall to said end closure against complete retention separation by forces created by reservoir fluid pressures above said predetermined pressure while being free of fluid pressure sealing between said wall and end closure permitting fluid flow therebetween; said wall and sealing ring being constructed and arranged with selected characteristics such that forces created on said wall by reservoir pressures immediately above said predetermined pressure will deform said wall to move said wall pressure sealing part partially away from said sealing ring to partially release compression therebetween and permit fluid flow between said wall and end closure automatically relieving reservoir pressures rising above said predetermined pressure.

2. In a pressure fluid reservoir as defined in claim 1 wherein upon cessation of said forces said wall will flex at least partially back to its original sealing ring compressing.

3. In a pressure fluid reservoir as defined in claim 2 in which said sealing ring in said end closure recess is a resilient material sealing ring.

4. In a pressure fluid reservoir as defined in claim 3 in which said end closure includes side and outer end surfaces, said annular recess being formed in said end closure side surface opening generally radially against said tubular wall inner end portion, said wall retention means being between said wall outer end portion and said end closure outer end surface; and in which said pressure sealing part of said wall inner end portion is an arcuate pressure sealing part.

5. In a pressure fluid reservoir as defined in claim 4 in which said outer end surface of said end closure has an axially outwardly projecting annular shoulder formed thereon comprising a part of said positive retention means; and in which said wall outer end portion is formed radially and axially inward over said end closure shoulder to also comprise a part of said positive wall retention means.

6. In a pressure fluid reservoir as defined in claim 1 in which said pressure sealing part of said wall inner end portion is an arcuate pressure sealing part.

7. In a pressure fluid reservoir as defined in claim 1 in which said sealing ring in said end closure recess is a resilient material sealing ring.

8. In a pressure fluid reservoir as defined in claim 1 in which said end closure includes side and outer end surfaces, said annular recess being formed in said end closure side surface opening generally radially against said tubular wall inner end portion, said wall retention means being between said wall outer end portion and said end closure outer end surface.

9. In a pressure fluid reservoir as defined in claim 5 in which said pressure sealing part of said wall inner end portion is an arcuate pressure sealing part.

10. In a pressure fluid reservoir as defined in claim 1 in which said end closure includes an outer end surface with an axially outwardly projecting annular shoulder formed thereon comprising a part of said positive wall retention means; and in which said wall outer end portion is formed radially and axially inwardly over said end closure shoulder to also comprise a part of said positive wall retention means.

11. In a pressure fluid reservoir as defined in claim 1 in which said end closure includes side and outer end surfaces, said outer end surface having an annular groove formed therein spaced from said side surface and forming an annular shoulder therebetween, said outer end surface shoulder and groove comprising a part of said positive wall retention means; and in which said wall outer end portion is formed radially over said end closure shoulder and into said end closure groove to also comprise a part of said positive wall retention means.

12. In a pressure fluid reservoir as defined in claim 1 in which said positive wall retention means includes an outer end surface on said end closure, said wall outer end portion being formed radially over said end closure outer end surface, an abutment collar secured to said end closure axially outwardly over said wall outer end portion pressure abutting said wall outer end portion axially against said end closure outer end surface.

13. In a method of containing high pressure fluid within a pressure fluid reservoir so as to have automatic fluid pressure relief above a reservoir predetermined pressure; the steps of: telescoping an end portion of a tubular wall axially over an end closure; positively securing an outer end portion of said wall to said end closure against complete retention separation from forces created by reservoir fluid pressures spaced above said predetermined pressure while maintaining freedom for fluid flow therebetween; normally fluid flow sealing an inner end portion of said wall inward of said outer end portion with said end closure during reservoir fluid pressures up to said predetermined pressure, including forming said wall inner end portion inwardly in an annular zone compressively against a sealing ring and said sealing ring compressively against said end closure; upon an attempt of reservoir fluid pressures to rise above said predetermined pressure, deforming said wall to move said wall inner end portion away from said end closure fluid flow sealing by reaction of said wall to reservoir fluid pressures immediately above said predetermined pressure to permit fluid flow outwardly along both of said wall inner and outer end portions and thereby relieve reservoir fluid pressures above said predetermined pressure without causing complete separation of said wall outer end portion securement.

14. In a method of containing high pressure fluid within a pressure fluid reservoir so as to have automatic fluid pressure relief above a reservoir predetermined pressure; the steps of: telescoping an end portion of a tubular wall axially over an end closure; positively securing an outer end portion of said wall to said end closure against complete retention from forces created by reservoir fluid pressures spaced above said predetermined pressure while maintaining freedom for fluid flow therebetween; normally fluid flow sealing an inner end portion of said wall inward of said outer end portion with said end closure during reservoir fluid pressures up to said predetermined pressure; including forming said wall inner end portion in an annular zone arcuately inwardly against a sealing ring recessed within a surface of said end closure and said sealing ring against said end closure; upon an attempt of reservoir fluid pressures to rise above said predetermined pressure, deforming said wall to move said wall inner end portion away from said end closure fluid flow sealing by reaction of said wall to reservoir fluid pressures immediately above said predetermined pressure to permit fluid flow outwardly along both of said wall inner and outer end portions and thereby relieve reservoir fluid pressures above said predetermined pressure without causing complete separation of said wall outer end portion securement.

15. In a method of containing high pressure fluid within a pressure fluid reservoir so as to have automatic fluid pressure relief above a reservoir predetermined pressure; the steps of: telescoping and end portion of a tubular wall axially over an end closure; positively securing an outer end portion of said wall to said end closure against complete retention separation from forces created by reservoir fluid pressures spaced above said predetermined pressure while maintaining freedom for fluid flow therebetween, including clamping an abutment member over said wall outer end portion to clamp said wall outer end portion against said end closure; normally fluid flow sealing an inner end portion of said wall inward of said outer end portion with said end closure during reservoir fluid pressures up to said predetermined pressure; upon an attempt of reservoir fluid pressures to rise above said predetermined pressure, deforming said wall to move said wall inner end portion away from said end closure fluid flow sealing by reaction of said wall to reservoir fluid pressures immediately above said predetermined pressure to permit fluid flow outwardly along both of said wall inner and outer end portions and thereby relieve reservoir fluid pressures above said predetermined pressure without causing complete separation of said wall outer end portion securement.

16. In a method of containing high pressure fluid within a pressure fluid reservoir so as to have automatic fluid pressure relief above a reservoir predetermined pressure; the steps of: telescoping an end portion of a tubular wall axially over an end closure; positively securing an outer end portion of said wall to said end closure against complete retention separation from forces created by reservoir fluid pressures spaced above said predetermined pressure while maintaining freedom for fluid flow therebetween including positively securing said outer end portion of said wall to said end closure by forming said wall outer end portion over an annular shoulder of said end closure and normally maintaining said wall outer end portion formation through inherent rigidity of said wall outer end portion after said formation; normally fluid flow sealing an inner end portion of said wall inward of said outer end portion with said end closure during reservoir fluid pressures up to said predetermined pressure; including forming said wall inner end portion in an annular zone arcuately inwardly compressively against a sealing ring recessed within a surface of said end closure and said sealing ring compressively against said end closure; upon an attempt of reservoir fluid pressures to rise above said predetermined pressure, deforming said wall to move said wall inner end portion away from said end closure fluid flow sealing by reaction of said wall to reservoir fluid pressures immediately above said predetermined pressure to permit fluid flow outwardly along both of said wall inner and outer end portions and thereby relieve reservoir fluid pressures above said predetermined without causing complete separation of said wall outer end portion securement, including deforming said wall at least partially by said wall inherent flexing; and in which said method includes the further step of after said relieving of said reservoir fluid pressures above said predetermined pressure, flexing said wall through said wall inherent flexure back into said compression with said sealing ring and said sealing ring with said end closure.

* * * * *